US010294545B2

(12) United States Patent
Ueno et al.

(10) Patent No.: US 10,294,545 B2
(45) Date of Patent: May 21, 2019

(54) METHOD OF PRODUCING A CARBON TOOL STEEL STRIP

(71) Applicant: HITACHI METALS, LTD., Minato-ku, Tokyo (JP)

(72) Inventors: Tomonori Ueno, Yasugi (JP); Hiroyoshi Fujihara, Yasugi (JP); Ichirou Kishigami, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 222 days.

(21) Appl. No.: 15/367,442

(22) Filed: Dec. 2, 2016

(65) Prior Publication Data

US 2017/0081743 A1 Mar. 23, 2017

Related U.S. Application Data

(63) Continuation of application No. 14/379,837, filed as application No. PCT/JP2013/056068 on Mar. 6, 2013, now abandoned.

(30) Foreign Application Priority Data

Mar. 8, 2012 (JP) ..... 2012-051195

(51) Int. Cl.
*C21D 9/52* (2006.01)
*C21D 8/02* (2006.01)
(Continued)

(52) U.S. Cl.
CPC ..... *C21D 9/46* (2013.01); *C21D 8/0205* (2013.01); *C21D 8/0236* (2013.01);
(Continued)

(58) Field of Classification Search
None
See application file for complete search history.

(56) References Cited

U.S. PATENT DOCUMENTS

2009/0260729 A1 10/2009 Iizuka et al.

FOREIGN PATENT DOCUMENTS

JP 60-128241 A 7/1985
JP 61-165079 A 7/1986
(Continued)

OTHER PUBLICATIONS

International Search Report for PCT/JP2013/056068 dated Jun. 4, 2013.

(Continued)

*Primary Examiner* — Deborah Yee
(74) *Attorney, Agent, or Firm* — Sughrue Mion, PLLC

(57) ABSTRACT

Provided is a carbon tool steel strip suitable for use in various spring materials, valve materials, and the like, in which press punching properties and fatigue characteristics are enhanced. A carbon tool steel strip having a thickness of 1 mm or less and a carbon tool steel composition containing 0.8-1.2% C by mass %, wherein the carbon tool steel strip has a Vickers hardness of 500-650 (Hv), and when a cross-section at the center in the sheet thickness direction of the carbon tool steel strip is viewed with the plane of observation in a direction at a right angle to a rolled surface of the carbon tool steel strip and in the length direction of the carbon tool steel strip, the area ratio of carbides having an equivalent circle diameter of at least 0.5 μm among the carbides present in the metallographic structure is 0.50-4.30%.

4 Claims, 1 Drawing Sheet

(51) Int. Cl.

| | |
|---|---|
| ***C21D 9/46*** | (2006.01) |
| ***C22C 38/00*** | (2006.01) |
| ***C22C 38/18*** | (2006.01) |
| ***C22C 38/02*** | (2006.01) |
| ***C22C 38/04*** | (2006.01) |

(52) U.S. Cl.

CPC ..... *C21D 8/0247* (2013.01); *C22C 38/00* (2013.01); *C22C 38/02* (2013.01); *C22C 38/04* (2013.01); *C22C 38/18* (2013.01); *C21D 9/52* (2013.01); *Y10T 428/12* (2015.01)

(56) References Cited

FOREIGN PATENT DOCUMENTS

| | | | |
|---|---|---|---|
| JP | 62-59167 | B2 | 12/1987 |
| JP | 7-138649 | A | 5/1995 |
| JP | 2002-60888 | A | 2/2002 |
| JP | 2006-63384 | A | 3/2006 |
| JP | 2008-69452 | A | 3/2008 |

OTHER PUBLICATIONS

Machine-English translation of JP61-165079, Kumagai Atsushi, Jul. 25, 1986.

Chattopadhyay, Ramnarayan, Green Tribology, Green surface Engineering and Global Warming, "Surface Roughness" pp. 104-106, 2011.

Machine-English translation of Japanese publication No. 60-128241 A, Kazunari Nakamoto et al., Jul. 9, 1985.

METHOD OF PRODUCING A CARBON TOOL STEEL STRIP

CROSS REFERENCE TO RELATED APPLICATIONS

This application is a continuation of application Ser. No. 14/379,837 filed Aug. 20, 2014, now abandoned which is a National Stage of International Application No. PCT/JP2013/056068 filed Mar. 6, 2013 (claiming priority based on Japanese Patent Application No. 2012-051195 filed Mar. 8, 2012), the contents of which are incorporated herein by reference in their entirety.

TECHNICAL FIELD

The present invention relates to a carbon tool steel strip suitable for use in various springs or valve materials, such as shock absorbers or flapper valves.

BACKGROUND ART

Conventionally, a carbon tool steel strip suitable for use in springs, valves, or the like is rolled to a predetermined thickness, then quenched and tempered to adjust target properties, and then processed into a target shape for use by e.g. blanking.

For carbon tool steel used after quenching and tempering in this manner, JPA-2006-63384 (Patent Literature 1), for example, proposes to improve impact properties by controlling an amount of residual carbides in a metallographic structure of the carbon steel. The proposed high carbon steel member has the improved impact properties by controlling a volume % (Vf) of unsolved carbides in a matrix within a range of $8.5<15.3\times C\ \%-Vf<10.0$.

CITATION LIST

Patent Literature

Patent Literature 1: JP-A-2006-63384

SUMMARY OF INVENTION

A carbon tool steel strip used for spring materials, valve materials, or the like is also required to have excellent blanking properties for being punched in a shape of a spring or a valve and high fatigue properties in addition to impact properties. However, sufficient studies have not been made on what metallographic structure is appropriate as a carbon tool steel strip in order to achieve both fatigue properties necessary for use as a spring or a valve and blanking properties important in a manufacturing process.

It is an object of the present invention to provide a carbon tool steel strip having improved blanking and fatigue properties and suitable for use in various spring materials, valve materials or the like.

The present inventors have found an appropriate form of carbides in a carbon tool steel strip that can achieve both fatigue and blanking properties in addition to improving hardness suitable for use in springs, valves or the like. Thus they arrived at the present invention.

Specifically, the present invention relates to a carbon tool steel strip having a composition comprising 0.8 to 1.2% of carbon by mass % and having a thickness of not greater than 1 mm. The strip has a Vickers hardness of 500 to 650 HV. When an observation plane is taken perpendicular to a rolled surface of the strip and parallel to a length direction of the strip and a cross-section is observed at a center portion in a thickness direction of the strip, an area ratio of carbides having an equivalent circle diameter of at least 0.5 μm among carbides present in a metallographic structure is 0.50 to 4.30%.

The area ratio of the carbides having an equivalent circle diameter of at least 0.5 μm is preferably in a range of 1.50% to 4.00%. In addition, the strip preferably has a thickness of 0.1 to 0.5 mm.

The strip of the present invention can have optimum hardness as well as both fatigue and blanking properties. The strip is particularly suitable for various spring or valve materials having a thickness of 0.1 to 0.5 mm.

DESCRIPTION OF EMBODIMENT

Figure 1:
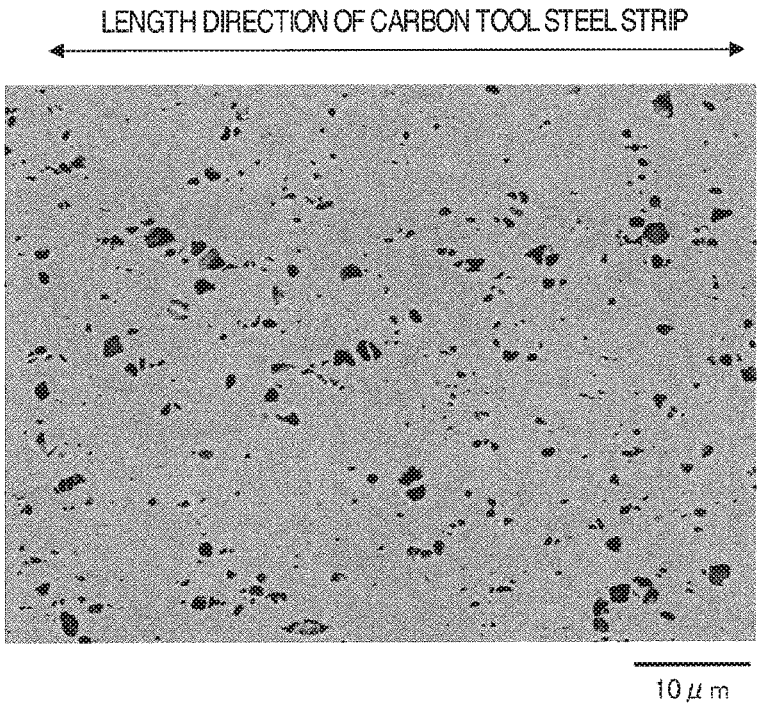
FIG. 1 is an electron micrograph of a cross-section of the carbon tool steel strip according to the present invention.

As described above, an important aspect of the present invention is to adjust an area ratio of carbides larger than a certain size after quenched and tempered to a certain range. Further, while hardness of the strip is optimized, both fatigue and blanking properties can be achieved.

Therefore, the strip according to the present invention has properties required as springs or valves at the same time. The thickness thereof is limited to not greater than 1 mm so that it can be applied to the springs, valves or the like.

First, a composition of the carbon tool steel strip according to the present invention will be described. The content of each element is expressed by mass %.

C: 0.8 to 1.2%

Carbon is a necessary element for obtaining mechanical properties such as hardness, or adequate wear resistance and impact resistance after quenching and tempering. In addition, carbon is necessary to adjust hardness and a form of carbides in appropriate ranges. Therefore, at least 0.8% of carbon is necessary. However, 1.2% of carbon lowers Ms point and causes deterioration of properties since retained austenite and residual carbides increase. Therefore, the carbon content is 0.8 to 1.2%. A preferable lower limit of carbon is more than 0.9%, and a preferable upper limit of carbon is 1.1%.

The composition of the carbon tool steel strip according to the present invention is not particularly limited except for the carbon content, and the strip may have a composition of carbon tool steel defined in JIS-G-3311 (Cold rolled special steel strip). Particularly, following composition is preferable.

Si: 0.1 to 0.35%

Si is added as a deoxidizing material for refining. Less than 0.1% of Si possibly has insufficient deoxidization effect and more than 0.35% of silicon may deteriorate mechanical properties. Therefore, the Si content is preferably 0.1 to 0.35%. A further preferable lower limit of Si is 0.15%, and a preferable upper limit of Si is 0.30%.

Mn: 0.1 to 0.5%

Mn is effective in improving quenching properties. Less than 0.1% of Mn possibly has insufficient improvement effect and more than 0.5% of Mn may deteriorate toughness.

Therefore, the Mn content is preferably 0.1 to 0.5%. A preferable lower limit of Mn is 0.35%, and a preferable upper limit of Mn is 0.48%.

Cr: 0.05 to 0.3%

Cr is effective in improving quenching properties. Therefore, it is preferable to add more than 0% of Cr. However, when Cr is added more than 0.3%, a pearlite is likely to be formed, and blanking properties are deteriorated. Therefore, a preferable amount of Cr is more than 0% and not more than 0.3%. In order to surely improve the quenching properties, a lower limit of Cr is preferably 0.05%. Since an oxide film is likely to be formed during quenching and tempering by the addition of Cr, a preferable upper limit of Cr is 0.25%.

Elements other than the above may be Fe and impurities.

Next, an area ratio of carbides defined in the present invention will be described.

In a carbon tool steel strip having the composition described above, a matrix of a metallographic structure of the strip is martensite after quenched and tempered. When retained austenite and pearlite increases, mechanical properties are deteriorated.

According to the present invention, the area ratio of carbides having an equivalent circle diameter of not less than 0.5 μm in the metallographic structure mainly composed of the martensite structure is defined as 0.50 to 4.30%. The carbides having the equivalent circle diameter of not less than 0.5 μm are likely to become origins of fatigue cracks. Thus, the amount of the carbides having the equivalent circle diameter of not less than 0.5 μm should be as small as possible in order to improve fatigue properties. On the other hand, when press works are conducted, the carbides having the equivalent circle diameter of not less than 0.5 μm become crack origins and are effective in reducing a punching load.

Therefore, the area ratio of the carbides having the equivalent circle diameter of not less than 0.5 μm has an effect on both fatigue and blanking properties. There is a preferable range that achieves both fatigue and blanking properties. When the area ratio of the carbides having the equivalent circle diameter of not less than 0.5 μm in the metallographic structure of the strip is less than 0.50%, the blanking properties deteriorate significantly. When the area ratio is more than 4.30%, the fatigue properties deteriorate significantly. Thus, according to the present invention, the area ratio of the carbides having the equivalent circle diameter of not less than 0.5 μm in the metallographic structure is defined as 0.50 to 4.30%. Further preferably, the lower limit of the area ratio is 1.50%, and a preferable upper limit of the area ratio is 4.00%. Although an upper limit of the carbide size is not particularly defined, when carbides having a size of larger than 5 μm are present for example, they are likely to causes fatigue cracks and the fatigue properties may be deteriorated significantly. Thus, the upper limit of the carbide size is preferably 5 μm in equivalent circle diameter.

Figure 2:
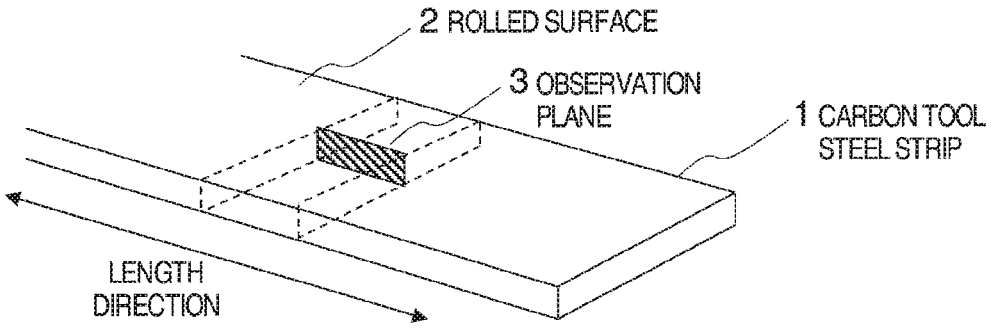
FIG. 2 is a schematic diagram showing an observation plane of a cross-sectional metallographic structure of the strip.

For evaluating the area of the carbides, a center portion in a thickness direction of a quenched and tempered carbon tool steel strip is observed such that an observation plane is taken in a length direction as shown in FIG. 2. Since the thickness of the strip is small, observation of the metallographic structure in a vicinity of a surface of the strip is affected by test piece preparation and thus variations in the metallographic structure are large.

A test piece for the carbide evaluation is embedded in a resin such that an observation plane 3 is perpendicular to a rolled surface 2 and parallel to a length direction of the strip 1 as shown in FIG. 2. The test piece is mirror-polished and then immersed in a sodium picrate-alkali liquid heated at 80 to 100° C. for about 10 minutes to color the carbides. An area of 6000 $\mu m^2$ at the center portion of the observation plane 3 is observed in a backscattered electron image with 2000 magnifications using a scanning electron microscope. The evaluation is possible with image processing such that only carbides having an equivalent circle diameter of not less than 0.5 μm among the observed carbides are identified to measure the area ratio.

The carbon tool steel strip is made to have Vickers hardness of 500 to 650 HV. Sufficient spring properties can not be ensured with a hardness of at less than 500 HV, while strength becomes too strong with a hardness of greater than 650 HV and the strip does not function as a spring or a valve. A preferable lower limit of the Vickers hardness is 520 HV, and a preferable upper limit of the Vickers hardness is 625 HV.

The carbon tool steel strip described above in detail may have a thickness to 0.1 to 0.5 mm for suitably used for springs or valves.

It is preferable to select quenching conditions in which a quenching temperature is slightly higher than that of conventional quenching and a tempering temperature is also higher, in order to provide a carbide form where the area ratio of the carbides having the equivalent circle diameter of not less than 0.5 μm in the metallographic structure is 0.50 to 4.30% according to the present invention. As specific quenching conditions, it is preferable that the quenching temperature is 830 to 940° C. and the heating and holding time is 20 to 170 seconds. When the quenching temperature is lower than 830° C., solution of carbides is insufficient and it is difficult to obtain the above carbide form. When the quenching temperature is higher than 940° C., a problem is likely to occur in which too much carbides are solved and residual carbides decrease. A preferable lower limit of the quenching temperature is 850° C. and a preferable upper limit of the quenching temperature is 920° C. In addition, when the heating and holding time for the quenching is shorter than 20 seconds or longer than 170 seconds, the area ratio of carbides of not less than 0.5 μm is less likely to be 0.50 to 4.30%.

As a rapid cooling method for the quenching, it is preferable that the steel strip is cooled to 200 to 350° C. in a salt bath, a molten metal, a mist or the like, and then the strip is sandwiched between two water-cooled press plates made of Cu or cast iron to be further cooled while being straightening, so as to complete martensitic transformation.

In addition, it is preferable to select suitable tempering conditions to provide appropriate hardness. Specifically, a tempering temperature is preferably in a range of 310 to 440° C. When the tempering temperature is lower than 310° C., the hardness increases. When the tempering temperature is higher than 440° C., the hardness is likely to decrease. A further preferable lower limit of the tempering temperature is 350° C., and a further preferable upper limit is 400° C. In addition, the tempering time is preferably 30 to 300 seconds. When the tempering time is shorter than 30 seconds, the hardness is likely to increase. When the tempering time is longer than 300 seconds, the hardness decreases too much.

In order to more surely increase fatigue strength of the carbon tool steel strip according to the present invention, surface roughness of the strip is made such that ten-point average roughness (Rz) defined in JIS-B-0601 is not more than 0.5 μm and arithmetic average roughness (Ra) is not more than 0.08 μm. In the ranges of the surface roughness, fatigue failure originating from surface defects such as flaws on the strip surface can be more surely prevented. The surface roughness is possibly different between front and back surfaces of the strip, and it is more preferable that the difference in roughness between the front and the back surfaces is within 0.15 μm (preferably within 0.10 μm) for the ten-point average roughness and within 0.015 μm (preferably within 0.012 μm) for the arithmetic average roughness (Ra).

In order to obtain the above-described surface roughness, the front and back surfaces of the strip after quenched and tempered may be physically ablated. For example, buffing with alumina or silica abrasive particles may be conducted.

Examples

The present invention will be described in more detail with the following Examples.

A carbon steel raw material was melt, cast and then hot-rolled to provide a hot-rolled material. The hot-rolled material was repeatedly cold-rolled and annealed to prepare a cold-rolled material A of a carbon tool steel strip having a thickness of 0.30 mm and a cold-rolled material B having a thickness of 0.20 mm.

The thickness and chemical composition of the cold-rolled materials A and B are described in Table 1.

TABLE 1

| Material | Thickness (mm) | Composition (mass %) C | Si | Mn | Cr | Balance |
|---|---|---|---|---|---|---|
| A | 0.30 | 0.965 | 0.245 | 0.440 | 0.131 | Fe and inevitable impurities |
| B | 0.20 | 0.965 | 0.245 | 0.440 | 0.131 | Fe and inevitable impurities |

The cold-rolled materials A and B were quenched and tempered to produce carbon tool steel strips.

Area ratio of carbides having an equivalent circle diameter of not less than 0.5 μm in a metallographic structure was varied by changing quenching conditions. The quenching and tempering conditions are shown in Table 2.

For the quenching and tempering, the temperature was set as shown in Table 2, and the cold-rolled material was held in a furnace for each time. Rapid cooling for the quenching was conducted with the material sandwiched between water-cooled press plates.

The tempered carbon tool steel strip was polished on front and back surfaces of the strip by buffing with alumina abrasive particles.

TABLE 2

| Sample | Material | Quenching conditions | Tempering conditions |
|---|---|---|---|
| 1 | A | 900° C. × 60 seconds holding → Rapid cooling | 380° C. × 90 seconds holding → Air cooling |
| 2 | A | 900° C. × 30 seconds holding → Rapid cooling | 380° C. × 90 seconds holding → Air cooling |
| 3 | A | 900° C. × 15 seconds holding → Rapid cooling | 380° C. × 90 seconds holding → Air cooling |
| 4 | B | 900° C. × 40 seconds holding → Rapid cooling | 380° C. × 60 seconds holding → Air cooling |
| 5 | B | 900° C. × 20 seconds holding → Rapid cooling | 380° C. × 60 seconds holding → Air cooling |

A test piece for observing a metallographic structure was cut from the produced carbon tool steel strip. The cut portions are shown by broken lines in FIG. 2. Then, the test piece was embedded in a resin such that an observation plane 3 is perpendicular to the rolled surface 2 of the strip 1 and parallel to the length direction of the strip as shown in FIG. 2. The test piece was mirror-polished and then immersed in a sodium picrate-alkali liquid heated at 80 to 100° C. for about 10 minutes to color carbides. An area of 6000 $\mu m^2$ at a center portion in a thickness direction was observed in a backscattered electron image at 2000 magnifications using a scanning electron microscope, and image processing was conducted. The area ratio of carbides of not lower than 0.5 μm was evaluated.

Next, five-point average Vickers hardness was measured in the vicinity of the observation portion of each sample. In addition, a test piece for evaluating fatigue properties was taken in a rolled direction. Alternating bending stress was applied and an S-N curve was produced to obtain a strength at finite life of $10^7$ times under which the strip breaks for $10^7$ repetitions.

In addition, evaluation of blanking properties was conducted.

A load was measured when a test piece having 10 mm width was punched with a punch and a die of 10 mm square. The measurement results are shown in Table 3.

As the backscattered electron image with 2000 magnifications of the observation plane of carbides, the image of Sample 2 is shown in FIG. 1. Black portions in FIG. 1 are carbides. The lateral direction in FIG. 1 corresponds to the length direction of the carbon tool steel strip. It is seen that carbides of not less than 0.5 μm are present at a preferable area ratio. In addition, as shown in FIG. 1, the maximum size of the carbides of Sample 2 is about 3 μm in equivalent circle diameter. The carbide maximum size of other samples of the present invention was also about 2 to 3 μm in equivalent circle diameter.

A test piece for observing the metallographic structure was taken from a position similar to that of the observation plane of the carbides. It was embedded in a resin, mirror-polished, and then etched with nital (a mixed solution of nitric acid and ethanol). Microstructure was observed by an optical microscope and it was confirmed that a matrix of the metallographic structure of the carbon tool steel strip was substantially martensite.

In addition, surface roughness after buffing was measured. The surface roughness was Rz: 0.39 μm at front surface, Rz: 0.33 μm at back surface, Ra: 0.068 μm at the front surface, and Ra: 0.061 μm at the back surface. It was confirmed that the carbon tool steel strip had smooth surface roughness.

TABLE 3

| Sample | Material | Area ratio of carbides of not less than 0.5 μm | Hardness (HV) | Strength at finite life of $10^7$ times (MPa) | Press load (kN) | Note |
|---|---|---|---|---|---|---|
| 1 | A | 0.58 | 555 | 1150 | 8.39 | Present invention |
| 2 | A | 3.69 | 566 | 1050 | 8.27 | Present invention |
| 3 | A | 4.34 | 547 | 1000 | 7.86 | Comparative example |
| 4 | B | 1.60 | 577 | 1100 | 5.90 | Present invention |
| 5 | B | 2.02 | 588 | 1050 | 5.85 | Present invention |

It is seen from Table 3 that the carbon tool steel strips in which the area ratio of carbides having an equivalent circle diameter of not less than 0.5 μm in the metallographic structure is within the range defined in the present invention have a hardness of greater than 550 HV and a strength at finite life of $10^7$ times of greater than 1000 MPa. They have a low press load of not greater than 8.5 (kN) for the materials having a thickness of 0.3 mm and not greater than 6.0 kN for the materials having a thickness of 0.2 mm.

It is seen therefrom that a carbon tool steel strip in which the area ratio of carbides having an equivalent circle diameter of not less than 0.5 μm in the metallographic structure is 0.50 to 4.30% has an excellent balance between mechanical properties.

The carbon tool steel strip according to the present invention can achieve both product properties, such as hardness and fatigue properties, and blanking properties. Therefore, it can be expected to be applied to springs or valves, particularly having a thickness of 0.1 to 0.5 mm.

REFERENCE SIGNS LIST

1 carbon tool steel strip
2 rolled surface
3 observation plane

What is claimed is:

1. A method of producing a carbon tool steel strip, comprising preparing a cold rolled strip having a composition comprising 0.8 to 1.2% of carbon by mass % and having a thickness of not more than 1 mm, heating and holding the cold rolled strip at 850 to 940° C. for 20 to 170 seconds and then quenching it, and tempering the quenched strip at 310 to 400° C. for 30 to 300 seconds, wherein the tempered strip has a Vickers hardness of 500 to 650 HV, and an area ratio of carbides having an equivalent circle diameter of not less than 0.5 μm among carbides in a metallographic structure is 0.50 to 4.30%, when an observation plane is taken perpendicular to a rolled surface of the strip and parallel to a length direction of the strip and a cross-section is observed at a center portion in a thickness direction of the strip in the observation plane.

2. The method according to claim 1, wherein the area ratio of the carbides having an equivalent circle diameter of not less than 0.5 μm is 1.50 to 4.00%.

3. The method according to claim 1, wherein the carbon tool steel strip has a thickness of 0.1 to 0.5 mm.

4. The method according to claim 1, wherein the carbon tool steel strip has ten-point average roughness (Rz) defined in JIS-B-0601 being not more than 0.5 μm and arithmetic average roughness (Ra) being not more than 0.08 μm.

* * * * *